US010518858B1

(12) United States Patent
Klawitter et al.

(10) Patent No.: US 10,518,858 B1
(45) Date of Patent: Dec. 31, 2019

(54) SYSTEMS AND STEERING ACTUATORS FOR STEERING OUTBOARD MARINE ENGINES

(71) Applicant: Brunswick Corporation, Lake Forest, IL (US)

(72) Inventors: Daniel P. Klawitter, Beaver Dam, WI (US); Timothy G. Langlitz, Oshkosh, WI (US); Benjamin C. Wald, Perkins, OK (US)

(73) Assignee: Brunswick Corporation, Mettawa, IL (US)

( * ) Notice: Subject to any disclaimer, the term of this patent is extended or adjusted under 35 U.S.C. 154(b) by 211 days.

(21) Appl. No.: 15/647,678

(22) Filed: Jul. 12, 2017

(51) Int. Cl.
*B63H 20/12* (2006.01)
*B63H 20/16* (2006.01)

(52) U.S. Cl.
CPC ..... *B63H 20/12* (2013.01); *B63H 20/16* (2013.01)

(58) Field of Classification Search
CPC ..... B63H 20/16; B63H 20/12
See application file for complete search history.

(56) References Cited

U.S. PATENT DOCUMENTS 2,871,830 A 2/1959 Wirth
3,310,284 A 3/1967 Seiuemon
3,645,296 A 2/1972 Adams
3,712,582 A 1/1973 Moesta
3,892,164 A 7/1975 Magor
3,939,938 A 2/1976 Inoue
4,146,244 A 3/1979 Presley
4,200,030 A 4/1980 Elser
4,362,515 A 12/1982 Ginnow
4,593,780 A 6/1986 Saito
4,841,790 A 6/1989 Williston et al.
5,074,193 A 12/1991 Hundertmark
5,129,273 A 7/1992 Fukui et al.
5,224,888 A 7/1993 Fujimoto et al.
5,376,029 A 12/1994 Entringer et al.
5,392,690 A 2/1995 Hundertmark
5,447,456 A 9/1995 Nakayasu
(Continued)

OTHER PUBLICATIONS

Joy Piloting System Installation Manual, 90-8M0093151 May 2014, particularly Section 5.

*Primary Examiner* — S. Joseph Morano
*Assistant Examiner* — Jovon E Hayes
(74) *Attorney, Agent, or Firm* — Andrus Intellectual Property Law, LLP

(57) ABSTRACT

A steering actuator is for steering an outboard marine engine about a steering axis. The steering actuator has a piston device and a valve device. Hydraulic actuation of the piston device causes the outboard marine engine to pivot about the steering axis. The valve device controls a flow of hydraulic fluid to the piston device to thereby hydraulically actuate the piston device. The valve device comprises a lead screw; a motor configured to rotate the lead screw in a first rotational direction and alternately in an opposite, second rotational direction; and a ball nut coupled to the lead screw such that rotation of the lead screw causes the ball nut to axially move along the lead screw, and wherein axial movement of the ball nut along the lead screw actuates the valve device, which thereby actuates the piston device to steer the outboard marine engine.

17 Claims, 10 Drawing Sheets

(56) References Cited

U.S. PATENT DOCUMENTS

| | | | | |
|---|---|---|---|---|
| 5,471,907 | A | 12/1995 | Kobelt | |
| 5,603,279 | A * | 2/1997 | Hundertmark | B62D 5/24 114/150 |
| 5,775,102 | A | 7/1998 | Frye | |
| 5,881,991 | A | 3/1999 | Bonin | |
| 5,947,155 | A | 9/1999 | Miki et al. | |
| 6,065,451 | A | 5/2000 | Lebrun | |
| 6,113,444 | A | 9/2000 | Ritger | |
| 6,234,853 | B1 | 5/2001 | Lanyi et al. | |
| 6,276,977 | B1 | 8/2001 | Treinen et al. | |
| 6,354,184 | B1 | 3/2002 | Hansen et al. | |
| 6,402,577 | B1 * | 6/2002 | Treinen | B63H 20/12 440/61 C |
| 6,755,703 | B1 | 6/2004 | Erickson | |
| 6,821,168 | B1 | 11/2004 | Fisher et al. | |
| 6,892,662 | B2 * | 5/2005 | Watanabe | B63H 20/12 114/144 R |
| RE39,032 | E | 3/2006 | Gonring et al. | |
| 7,131,385 | B1 | 11/2006 | Ehlers et al. | |
| 7,150,664 | B1 * | 12/2006 | Uppgard | B63H 20/12 440/53 |
| 7,168,360 | B2 | 1/2007 | Massaccesi et al. | |
| 7,311,572 | B2 | 5/2007 | Yamashita et al. | |
| 7,255,616 | B1 | 8/2007 | Caldwell | |
| 7,284,634 | B2 | 10/2007 | Tatewaki et al. | |
| 7,699,674 | B1 * | 4/2010 | Wald | B63H 25/30 440/58 |
| 8,246,398 | B2 | 8/2012 | Inaba | |
| 9,849,957 | B1 * | 12/2017 | Grahl | B63H 20/32 |
| 2003/0150367 | A1 | 8/2003 | Hundertmark | |
| 2005/0170712 | A1 * | 8/2005 | Okuyama | B63H 20/12 440/59 |
| 2007/0137327 | A1 | 6/2007 | Heitzer | |
| 2008/0113571 | A1 * | 5/2008 | Zelm | B63H 20/12 440/53 |
| 2015/0367924 | A1 | 12/2015 | Davis | |

* cited by examiner

SYSTEMS AND STEERING ACTUATORS FOR STEERING OUTBOARD MARINE ENGINES

FIELD

The present disclosure relates to outboard marine engines and more particularly to systems and steering actuators for steering outboard marine engines.

BACKGROUND

The following U.S. Patents are incorporated herein by reference, in entirety.

U.S. Pat. No. 4,362,515 discloses an improved steering system having a guide tube fixed to the end of the outer casing of a steering cable. A link rod connects between the steering arm and the inner core of the steering cable. A guide means is fixed with respect to the transom support means to guide the linear movement of the inner core. A limiting means limits the range of movement of the inner core and a restoring means moves the steerable drive unit from the extreme range of the range of movement of the ram.

U.S. Pat. No. 5,074,193 discloses a marine hydraulic system for operation of a power steering assembly that includes a pressure accumulator to provide pressurized hydraulic fluid and valves that permit the transfer of hydraulic fluid within the cylinder to provide efficient use of hydraulic fluid.

U.S. Pat. No. 5,376,029 discloses a control valve for a pressurized fluid-operated system, such as a marine power steering system, which includes a housing having an inlet and at least one outlet, with one or more work ports located there between. Pressurized fluid is supplied to the inlet, and a spool member is mounted within the housing for controlling the supply of pressurized fluid to a work-performing system, such as the extendible and retractable rod of a hydraulic cylinder assembly. The spool member includes structure for blocking the one or more work ports when the spool member is in its neutral position, when it is desired not to operate the system. This prevents the cylinder from being exposed to reservoir fluid when the spool member is in its neutral position.

U.S. Pat. No. 5,392,690 discloses a marine hydraulic system for operation of a power steering assembly that includes a pressure accumulator to provide pressurized hydraulic fluid and valves that permit the transfer of hydraulic fluid within the cylinder to provide efficient use of hydraulic fluid.

U.S. Pat. No. 6,113,444 discloses a rotary actuator used to steer a watercraft with an outboard motor. First and second brackets are attached to the outboard motor and the transom of the watercraft, respectively. The rotary actuator can be a hydraulic rotary actuator and either the rotor portion or stator portion of the rotary actuator can be attached to the outboard motor with the other portion being attached to the transom. A hydraulic pump is used to provide pressurized fluid to the actuator and a valve is used to selectively direct the pressurized fluid to one of two ports in the rotary actuator to select the directional rotation and speed between the stator portion and the rotor portion.

U.S. Pat. No. 6,276,977 discloses a hydraulic actuator for an outboard motor system in which the cylinder and piston of the actuator are disposed within a cylindrical cavity inside a cylindrical portion of a swivel bracket. The piston within the cylinder of the actuator is attached to at least one rod that extends through clearance holes of a clamp bracket and is connectable to a steering arm of an outboard motor. The one or more rods attached to the piston are aligned coaxially with an axis of rotation about which the swivel bracket rotates when the outboard motor is trimmed. As a result, no relative movement occurs between the outboard motor, the rod attached to the piston of the actuator, and the swivel bracket during rotation of the outboard motor about the axis of rotation.

U.S. Pat. No. 6,402,577 discloses a hydraulic steering system in which a steering actuator is an integral portion of the support structure of a marine propulsion system. A steering arm is completely contained within the support structure of the marine propulsion system and disposed about its steering axis. An extension of the steering arm extends into a sliding joint which has a linear component and a rotational component which allow the extension of the steering arm to move relative to a moveable second portion of the steering actuator. The moveable second portion of the steering actuator moves linearly within a cylinder cavity formed in a first portion of the steering actuator.

U.S. Pat. No. 6,821,168 discloses an outboard motor that is provided with an internally contained cylinder and moveable piston. The piston is caused to move by changes in differential pressure between first and second cavities within the cylinder. By adding a hydraulic pump and a steering valve, the hydraulic steering system described in U.S. Pat. No. 6,402,577 is converted to a power hydraulic steering system by adding a hydraulic pump and a steering valve to a manual hydraulic steering system.

U.S. Pat. No. 7,150,664 discloses a steering actuator system for an outboard motor that connects an actuator member to guide rails which are, in turn, attached to a motive member such as a hydraulic cylinder. The hydraulic cylinder moves along a first axis with the guide rail extending in a direction perpendicular to the first axis. An actuator member is movable along the guide rail in a direction parallel to a second axis and perpendicular to the first axis. The actuator member is attached to a steering arm of the outboard motor.

U.S. Pat. No. 7,255,616 discloses a steering system for a marine propulsion device that eliminates the need for two support pins and provides a hydraulic cylinder with a protuberance and an opening which cooperate with each other to allow a hydraulic cylinder's system to be supported by a single pin for rotation about a pivot axis. The single pin allows the hydraulic cylinder to be supported by an inner transom plate in a manner that allows it to rotate in conformance with movement of a steering arm of a marine propulsion device.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

A steering actuator is for steering an outboard marine engine about a steering axis. The steering actuator has a piston device and a valve device. Hydraulic actuation of the piston device causes the outboard marine engine to pivot about the steering axis. The valve device controls a flow of hydraulic fluid to the piston device to thereby hydraulically actuate the piston device. The valve device comprises a lead screw; a motor configured to rotate the lead screw in a first rotational direction and alternately in an opposite, second rotational direction; and a ball nut coupled to the lead screw such that rotation of the lead screw causes the ball nut to axially move along the lead screw. Axial movement of the ball nut along the lead screw actuates the valve device, which thereby actuates the piston device to steer the outboard marine engine.

BRIEF DESCRIPTION OF THE DRAWINGS

The present disclosure is described with reference to the following drawing Figures. The same numbers are used throughout the drawing Figures to reference like Figures and like components.

DETAILED DESCRIPTION OF THE DRAWINGS

Figure 1:
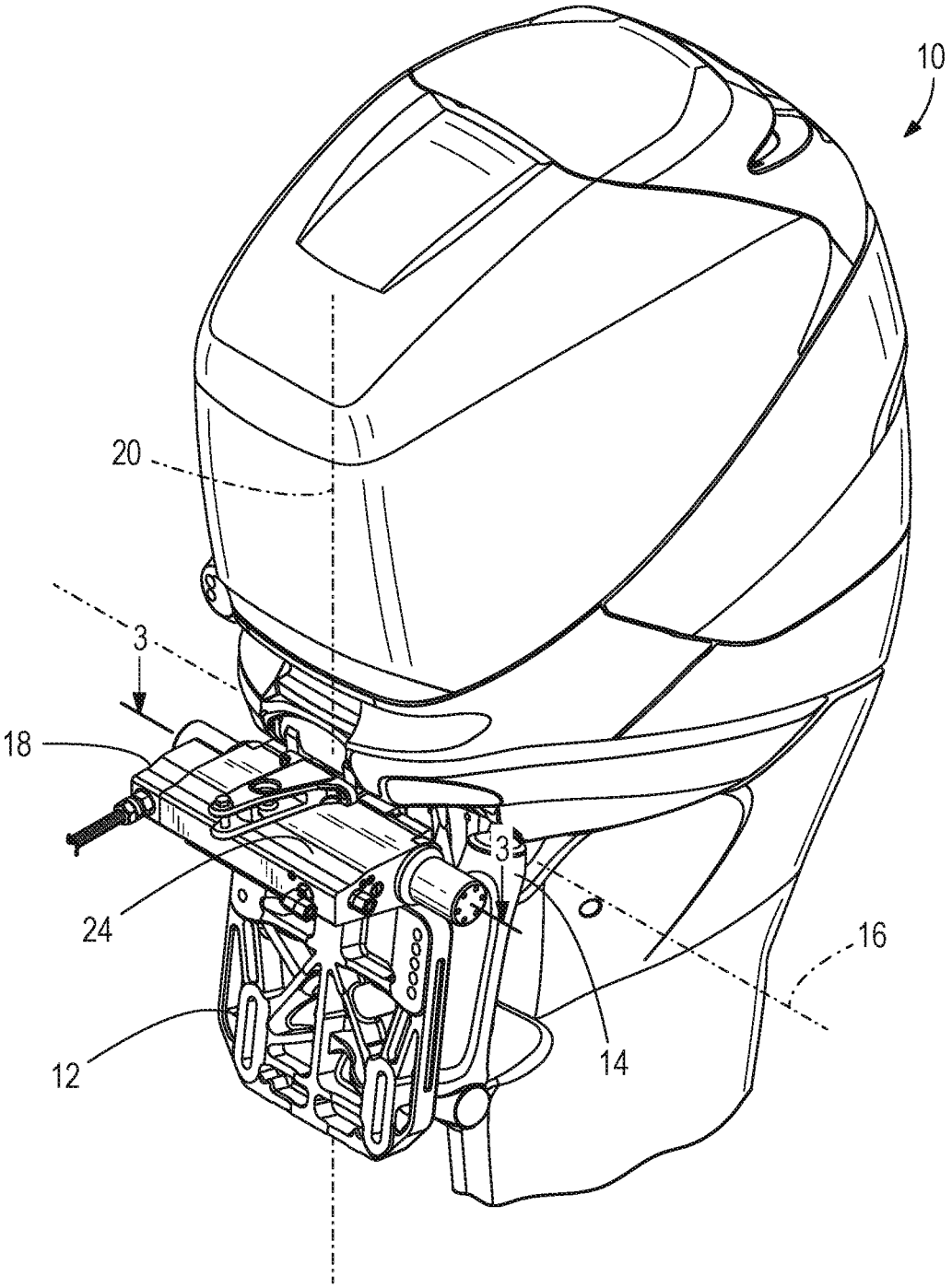
FIG. 1 is a perspective view of an outboard marine engine having a steering actuator according to the present disclosure.
Figure 2:
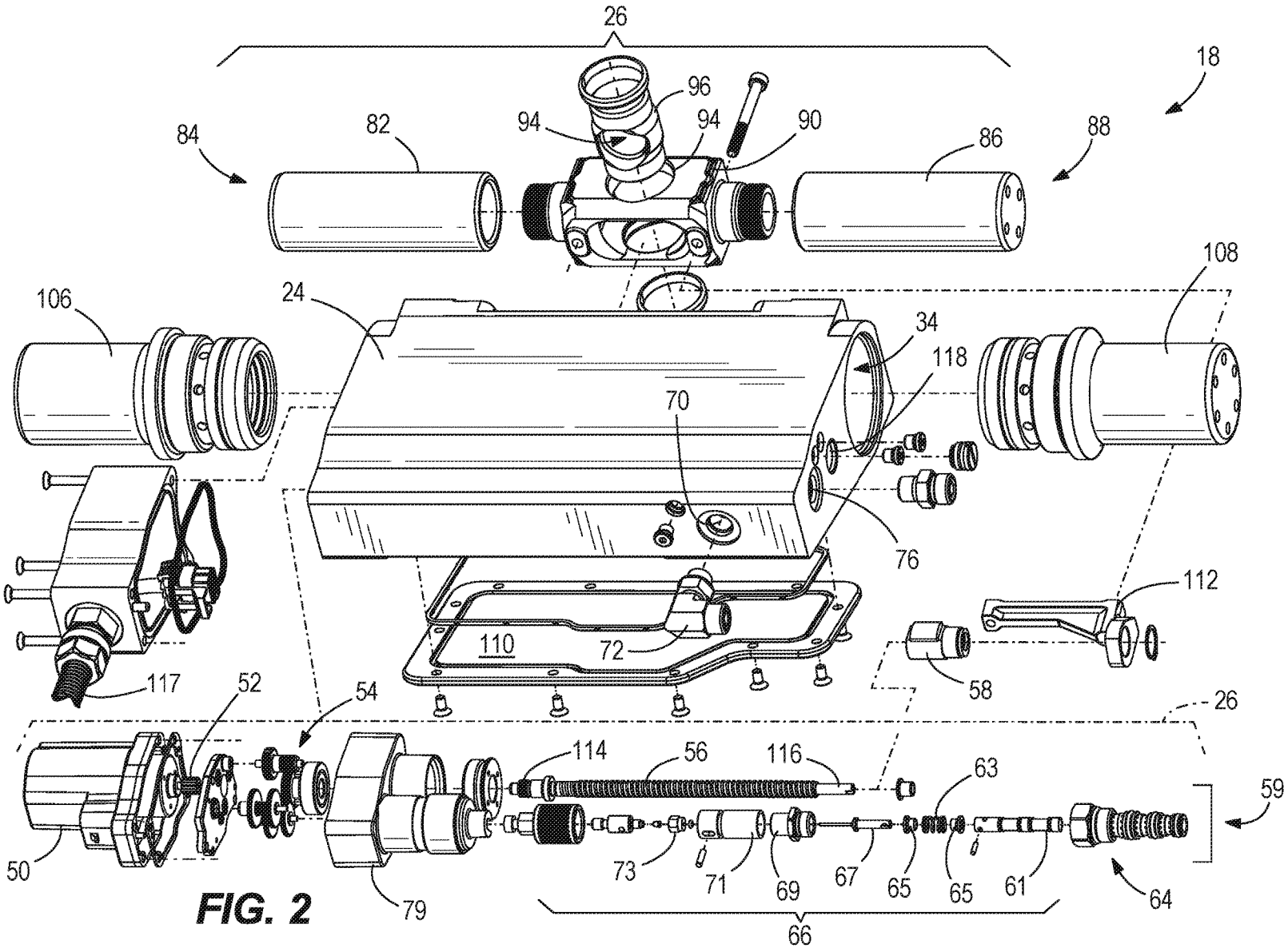
FIG. 2 is an exploded view of an exemplary steering actuator.

FIG. 1 depicts and outboard marine engine 10 and a conventional transom plate 12 for mounting the outboard marine engine 10 on the stern of a marine vessel (not shown). A pair of trim cylinders 14 (only one is shown in FIG. 1) is configured to trim the outboard marine engine 10 about a horizontal trim axis 16. A novel steering actuator 18 according to the present disclosure is configured to steer the outboard marine engine 10 about a vertical steering axis 20. FIG. 1 shows the steering actuator 18 and FIG. 6 shows a control system 22 for the steering actuator 18. FIG. 2 shows the steering actuator 18 in exploded view. FIGS. 3-5C depict the steering actuator 18 during various operational states and positions, which occur as the control system 22 causes the steering actuator 18 to steer the outboard marine engine 10 in first and opposite, second pivot directions about the vertical steering axis 20, all as will be explained further herein below.

The following description first explains the various components of the steering actuator 18 and the control system 22, primarily with reference to FIGS. 2 and 6. Thereafter, the manner in which the components of the steering actuator 18 and the control system 22 function to steer the outboard marine engine 10 is described, primarily with reference to FIGS. 3-5C.

Referring now to FIGS. 2 and 6, the steering actuator 18 includes a housing 24 that contains a piston device 26 and valve device 28. Hydraulic actuation of the piston device 26 causes the outboard marine engine 10 to pivot in the first pivot direction (shown in FIG. 4C) about the vertical steering axis 20 and alternately to pivot in the opposite, second pivot direction (shown in FIG. 5C) about the vertical steering axis 20. As explained further herein below, the valve device 28 is specially configured to control actuation of the piston device 26 by alternately controlling a flow of hydraulic fluid to first and opposite, second sides 30, 32 of the piston device 26—to thereby cause the piston device 26 to alternately move in first and opposite, second piston directions in the housing 24.

The housing 24 has parallel, axially extending first and second cavities 34, 36, which are best shown in FIGS. 3-5C. The piston device 26 is disposed in the first cavity 34 and the valve device 28 is disposed in the second cavity 36. The valve device 28 moves into and between three positions within the second cavity 36, including a neutral position (shown in FIGS. 3, 4C, 5C, and 6) wherein the valve device 28 is axially positioned within the second cavity 36 so as to open fluid passage 23 (see e.g. FIG. 6) that direct a flow of hydraulic fluid from a pump 38 back to a hydraulic fluid supply tank 40, a first valve position (shown in FIGS. 4A and 4B) wherein the valve device 28 is axially positioned within the second cavity 36 so as to open fluid passage 25 (see FIG. 6) that direct the flow of hydraulic fluid from the pump 38 to a first side 42 of the piston device 26, and second valve position (shown in FIGS. 5A and 5B) wherein the valve device 28 opens fluid passage 27 (see FIG. 6) that direct the flow of hydraulic fluid to a second side 44 of the piston device 26. As mentioned above and further described herein below, conducting flow of hydraulic fluid to opposite sides of the piston device 26 actuates the piston device 26 and thus causes steering movement of the outboard marine engine 10.

Referring now to FIG. 6, the control system 22 is configured to control the valve device 28. The control system 22 includes a computer controller 46 that is programmable and includes a computer processor, software, memory (i.e. computer storage) and an associated input/output (interface) device. The processor loads and executes software, which can be stored in the memory. Executing the software controls the control system 22 to operate as described herein in further detail below. The processor can include a microprocessor and/or other circuitry that receives and executes software. The software can be implemented with a single device, but can also be distributed across multiple processing devices and/or subsystems that cooperate in executing program instructions. Examples include general purpose central processing units, application specific processors, and logic devices, as well as other processing devices, combination of the processing devices, and/or variations thereof. The controller 46 can be located anywhere with respect to the outboard marine engine 10 and associated marine vessel and can communicate with various components of the control system 22 via wired and/or wireless links, examples of which are shown in FIG. 6. The controller 46 can have one or more microprocessors that are located together or remotely from each other in the control system 22 or remotely from the control system 22.

The control system 22 can further include a memory which can be any storage media that is readable by the processor and capable of storing software. For example, the memory can include volatile and/or nonvolatile removable and/or non-removable media implemented in any media or technology for storage of information. The input/output device can include any one of a variety of conventional computer input/output interfaces for receiving electrical signals for input to the processor and for sending electrical signals from the processor to various components of the control system 22. The controller 46 via the noted input/output device, communicates with components of the outboard marine engine 10 via communication links, which as mentioned herein above can be wired or wireless links. As further explained herein below, the controller 46 is capable of monitoring and controlling operational characteristics of the outboard marine engine 10 by sending and/or receiving control signals via the links shown in FIG. 6.

The controller 46 can be configured to receive inputs from a user input device 48, which can for example include a conventional steering wheel, joystick, touch, touchscreen and/or the like. The controller 46 is configured to output control signals to the steering actuator 18 to, for example, control the valve device 28 as further described herein below. In some examples, the controller 46 can also be configured to generate output command signals that control the valve device 28 based upon programming stored within the memory of the controller 46, such as for example in station keeping modes, trolling modes, way point tracking modes, auto heading, and/or the like, all of which are well known by those having ordinary skill in the art.

Referring to FIGS. 2 and 6, the valve device 28 is an assembly that includes an electrically-powered bi-directional motor 50 that is controlled by the controller 46. A power connector 117 extends through the housing 24 and provides electrical power to the motor 50. The controller 46 controls the motor 50 to cause rotation of a motor output shaft 52 about its own axis in a first rotational direction 55 (see FIG. 4A) and alternately to cause rotation of the motor output shaft 52 about its own axis in the opposite, second rotational direction 57 (see FIG. 5A). The motor output shaft 52 is engaged with and causes rotation of a gear set 54, which in turn is geared to an elongated lead screw 56 that extends through the second cavity 36. Rotation of the motor output shaft 52 causes commensurate rotation (e.g. at a 14:1 reduction or other suitable relationship) of the lead screw 56 about its own axis. The lead screw 56 has a first end 114 coupled to the motor 50 via the gear set 54 and an opposite, second end 116 supported by the housing 24. An access port 118 is formed through the housing 24 and facilitates operator access to the second end 116 of the lead screw 56 for positional adjustment of the lead screw 56, motor 50, and rest of the valve device 28. For example a manual tool such as a screw driver can be inserted into the access port 188 and engaged with the second end 116 of the lead screw 56. Rotation of the screw driver will adjust the position of the lead screw 56, motor 50, etc.

Figure 3:
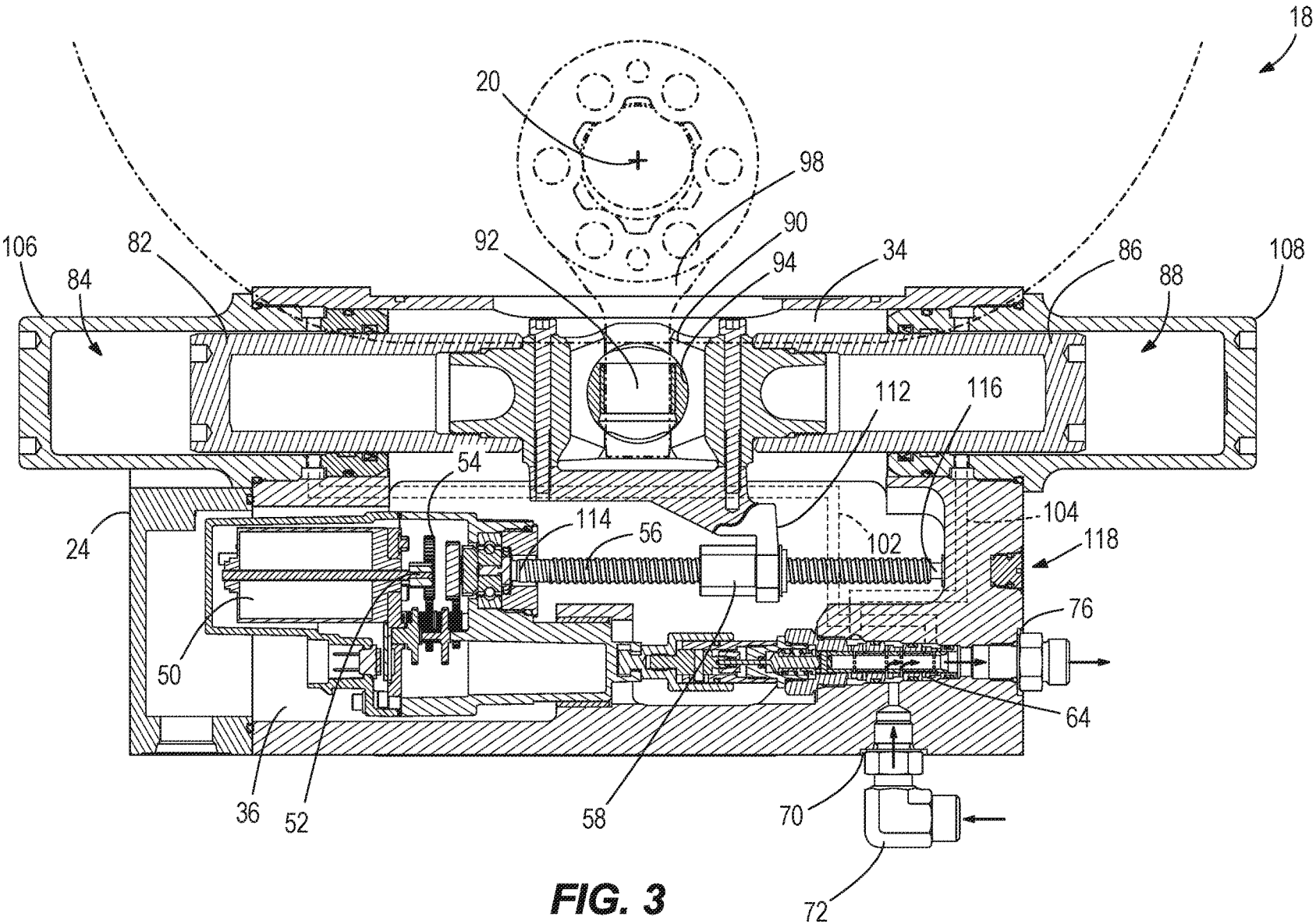
FIG. 3 is a sectional view, showing the steering actuator in a neutral position.

A ball nut 58 is coupled to the lead screw 56 via a threaded connection such that rotation of the lead screw 56 causes the ball nut 58 to axially move along the lead screw 56. The ball nut 58 is also rigidly connected to the piston device 26 by a rigid connection bracket 112, as will be described further herein below. Rotation of the lead screw 56 in the first rotational direction 55 causes the ball nut 58 to move along the lead screw 56 in a first axial direction 60 (see FIG. 4A). Rotation of the lead screw 56 in the opposite, second rotational direction 57 causes the ball nut 58 to move along the lead screw 56 in an opposite, second axial direction 62 (see FIG. 5A). Referring to FIG. 3, the connection bracket 112 rigidly connects the ball nut 58 to the trunnion 90 of the piston device 26. As shown in FIG. 3, the valve device 28 is elongated and the lead screw 56 is elongated and extends parallel to and is spaced apart from a cartridge valve 59, which is explained further herein below. The lead screw 56 is not coaxial with the motor output shaft 52, i.e. it is offset with respect to the motor output shaft 52.

Referring to FIGS. 2 and 3, the valve device 28 further includes the cartridge valve 59, which is coupled to the motor 50. The type of cartridge valve 59 can vary from what is shown. In the illustrated example, the cartridge valve 59 is a commercially available cartridge valve from Parker Hannifin, Part No. DMH085C9. Since this is a conventional component, the cartridge valve 59 is only briefly described herein below. Further details are readily available from Parker Hannifin. The cartridge valve 59 includes a valve body 64 and a valve assembly 66, which includes a spool 61, a centering spring 63 that is retained in place by opposing spring retainers 65, a plunger 67, an extension 69, a stroke limiter 71, a coupler 73, and adapters 75, 77. A housing 79 couples the valve device 28 to the motor 50. The centering spring 63 tends to bias the valve body 64 into the axially central, neutral position shown in FIG. 3. As described further herein below, the cartridge valve 59 and second cavity 36 define the plurality of fluid passages 23, 25, 27 (see FIG. 6) for conveying a flow of hydraulic fluid from the pump 38 alternately to opposite sides of the piston device 26 or back to the hydraulic fluid supply tank 40, depending on the axial position of the cartridge valve 59 in the second cavity 36. The fluid passages 23, 25, 27 are shown with flow arrows in FIGS. 4B and 5B, but for better understanding are also shown schematically and itemized in FIG. 6.

Referring to FIGS. 2 and 6, the housing 24 has a hydraulic fluid inlet 70 to which an inlet fitting 72 is connected. Inlet fitting 72 couples the inlet 70 to the pump 38 to provide flow of hydraulic fluid from the pump 38 to the valve device 28. The housing 24 also has a hydraulic fluid outlet 76 to which an outlet fitting 74 is connected. The outlet fitting 78 couples the outlet 76 to a reservoir of hydraulic fluid supply tank 40 containing hydraulic fluid.

Referring to FIG. 2, the piston device 26 has a first piston 82 that is on a first side 84 of the piston device 26 and a second piston 86 that is on an opposite, second side 88 of the piston device 26. In this example, the piston device 26 includes a trunnion 90 that is disposed in the first cavity 34 between the first and second pistons 82, 86. A pivot pin 92 (see e.g. FIG. 4A) extends from the trunnion 90, transversely with respect to the first cavity 34, and is received in a transverse recess 94 formed in a vertical trunnion sleeve 96. The pivot pin 92 is coupled to a steering arm 98 on the outboard marine engine 10, as shown in dashed lines in FIGS. 3-5C. Axial movement of the trunnion 90 in the first cavity 34 causes the trunnion sleeve 96 to rotate about its own axis, which in turn causes movement of the steering arm 98 and pivoting movement of the outboard marine engine 10 about the vertical steering axis 20, as shown in FIGS. 3-5C.

Referring to FIGS. 3-5C a first hydraulic fluid passageway 102 (shown in dashed line) conveys the flow hydraulic fluid from the fluid passage 25 in the valve device 28 to the first side 84 of the piston device 26 to thereby increase hydraulic fluid pressure on the first side 84. Increasing hydraulic fluid pressure on the first side 84 causes the first piston 82 to move and thereby move the trunnion 90 in the first piston direction (i.e. to the right in the Figures). A second hydraulic fluid passageway 104 (shown in dashed line) conveys the flow of hydraulic fluid from the fluid passage 27 in the valve device 28 to the second side 88 of the piston device 26 to thereby increase the hydraulic fluid pressure on the second side 88. Increasing hydraulic fluid pressure on the second side 88 causes the second piston 86 to move and thereby move the trunnion in the opposite, second piston direction (i.e. to the left in the Figures). As further described herein below, the flow of hydraulic fluid to the first and second hydraulic fluid passageways 102, 104 is controlled by the axial position of the valve device 28 in the second cavity 36 and the noted fluid passages 23, 25, 27 shown schematically in FIG. 6.

Referring to FIG. 2, a first endcap 106 is disposed on the first side 84 of the piston device 26 and second endcap 108 is disposed on the second side 88 of the piston device 26. The first and second endcaps 106, 108 enclose the piston device 26 in the first cavity 34. A removable lower access panel 110 is connected to the housing 24 and encloses the first and second cavities 34, 36, thus providing access to the piston device 26 and valve device 28 for servicing.

A rotary position sensor can be coupled to the motor 50 and configured to sense position of the steering actuator 18 and provide feedback to the controller 46.

Operation of the steering actuator 18 will now be described with reference to FIG. 3. In general, rotation of the motor 50 causes axial movement of the entire valve device 28, including the cartridge valve 59, in the second cavity 36, which aligns different ones of the fluid passages 23, 25, 27 with the inlet 70 and thereby causing hydraulic pressure to move the piston device 26 and steer of the outboard marine engine 10.

FIG. 3 depicts the valve device 28 in the neutral position wherein the fluid passage 23 in the valve device 28 directs flow of hydraulic fluid from the pump 38 back to the hydraulic fluid supply tank 40. The flow of hydraulic fluid enters the inlet 70 via the inlet fitting 72 and is conveyed through the fluid passage 23 (see FIG. 6) back to the hydraulic fluid supply tank 40 via the outlet 76 and outlet fitting 78. The cartridge valve 59 is biased into the neutral position by the coil spring 63. The motor 50 and lead screw 56 are also biased into the neutral position, since they are rigidly connected to the cartridge valve 59 via the valve assembly 66. The pressure of the hydraulic fluid on the first and second sides 84, 88 of the piston device 26 is roughly equal and the outboard marine engine 10 is depicted in a straightforward orientation with respect to the vertical steering axis 20 and the not shown marine vessel.

Figure 4A:
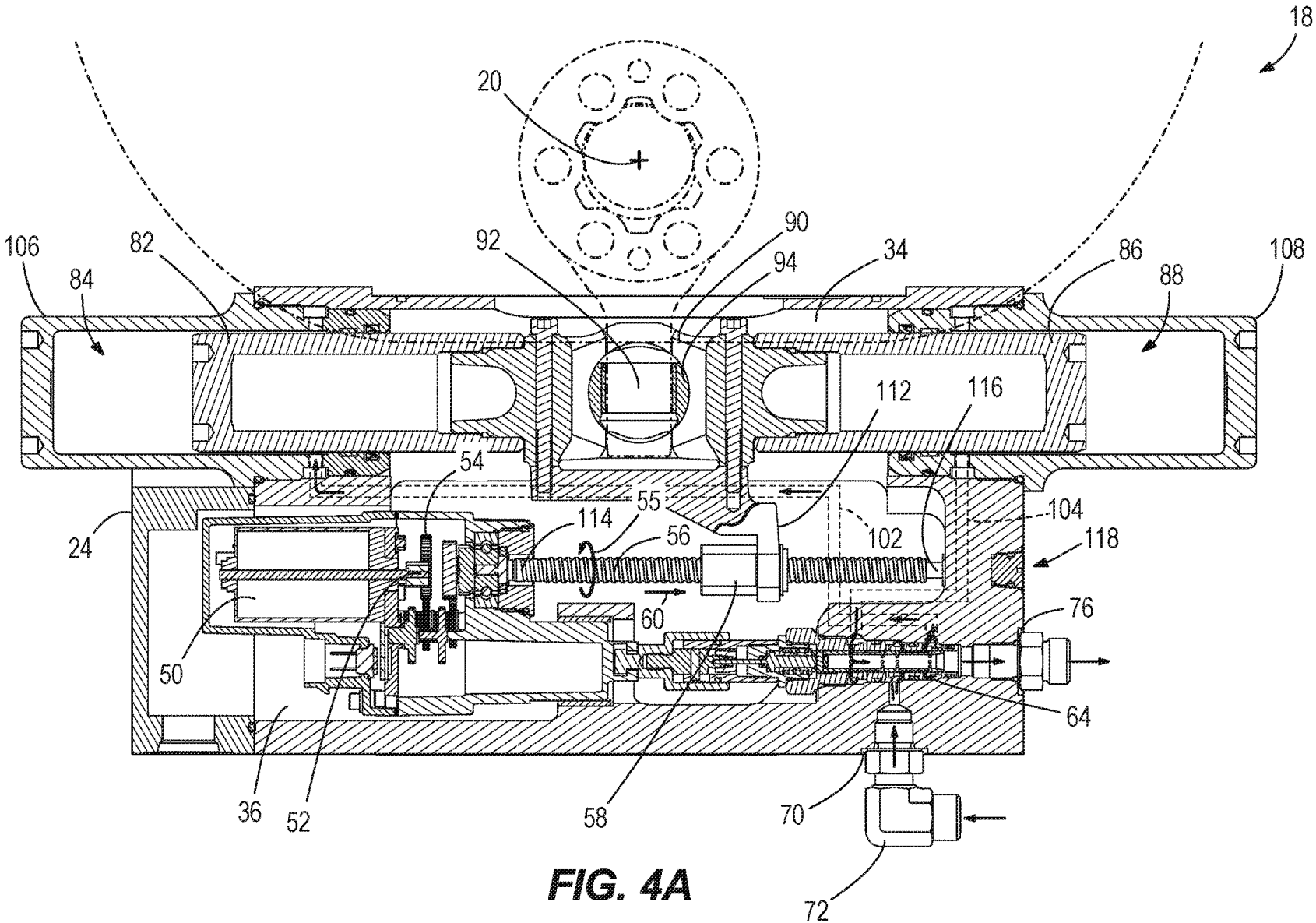
FIG. 4A is a sectional view of the steering actuator, showing movement of a valve device into a first position.
Figure 4B:
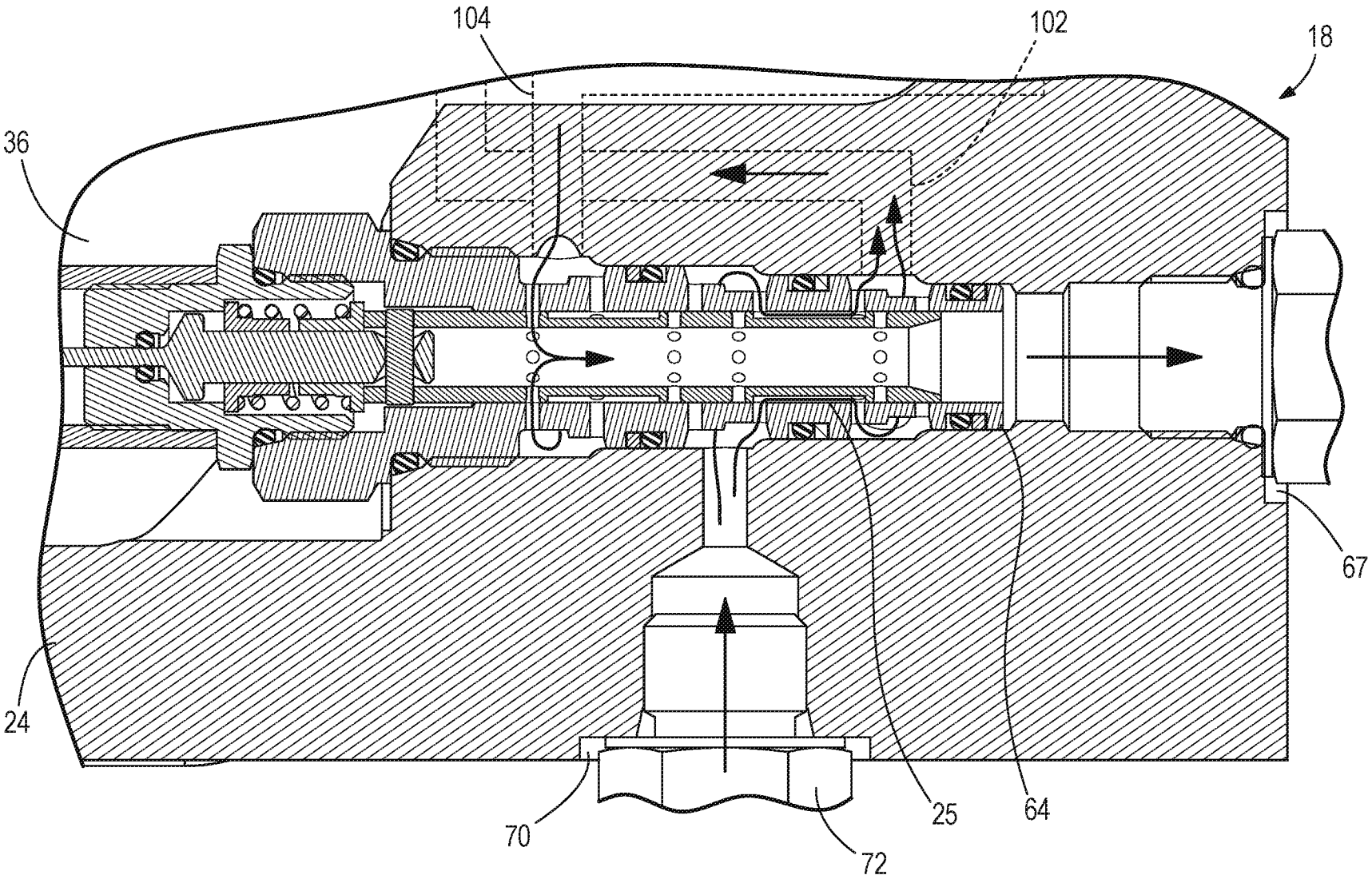
FIG. 4B is a closer sectional view of the valve device shown in FIG. 4A.
Figure 4C:
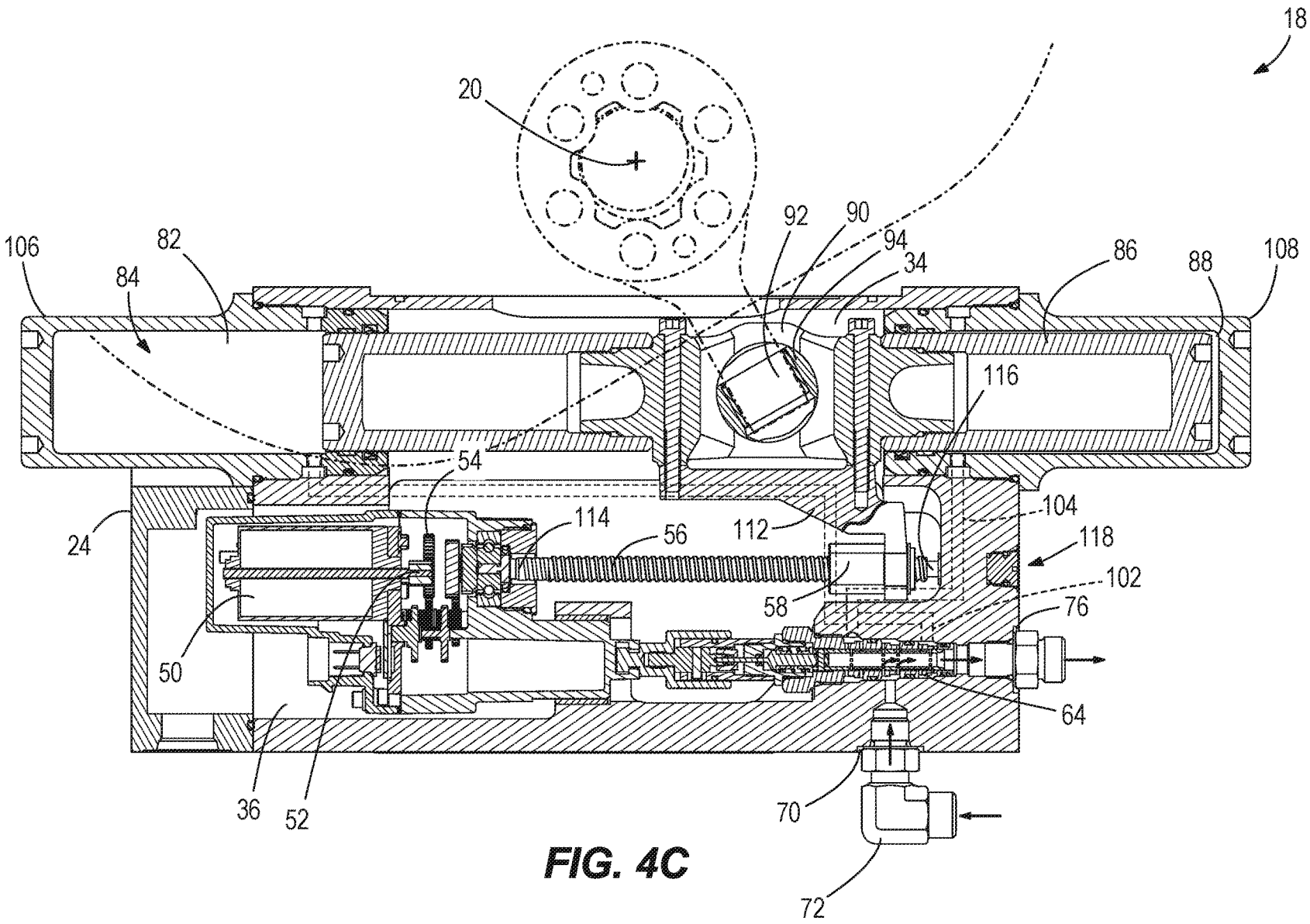
FIG. 4C is a sectional view of the steering actuator, showing the valve device back in the neutral position after pivoting movement of the outboard marine engine in a first pivot direction.

FIG. 4A depicts the steering actuator 18 upon and input to the controller 46 for steering movement of the outboard marine engine 10 in the first pivot direction. The controller 46 controls the motor 50 to rotate the output shaft in the first rotational direction, which causes rotation of the lead screw 56, thus resulting in translation of the ball nut 58 along the lead screw 56, away from the motor 50. Initial movement of the lead screw 56 and associated connection bracket 112 (i.e. to the right in FIG. 4A) is prevented by the relatively heavy weight of the outboard marine engine 10 resisting movement of the connection bracket 112. That is, the ball nut 58 is connected to the outboard marine engine 10 via the connection bracket 112 and trunnion 90. The force required to move the outboard marine engine 10 about its vertical steering axis 20 is greater than the force required to move the valve device 28 including the motor 50, valve assembly 66, and cartridge valve 59, reversely in the second cavity 36. As such, rotation of the motor 50 in the first rotational direction causes the motor 50 and cartridge valve 59 to both move to the left in FIG. 4A, which causes the fluid passage 25 in the cartridge valve 59 to align with the inlet 70 and outlet 76. This causes flow of hydraulic fluid from the pump 38 to flow to the first hydraulic fluid passageway 102 and then into the first side 84 of the piston device 26. As shown in FIGS. 4B and 4C, increasing the flow of hydraulic fluid to the first side 84 of the piston device 26 via the first hydraulic fluid passageway 102 increases the pressure on the first side 84 which acts on the first piston 82 and causes the first piston 82 to move the piston device 26 in the first piston direction (i.e. to the right in the Figures), which in turn, causes the outboard marine engine 10 to pivot in a first pivot direction, as shown in dashed lines in FIG. 4C. Once the requested pivoting movement of the outboard marine engine 10 achieved (i.e. the requested pivoting movement that is inputted to the controller 46 via for example the user input device 48), the controller 46 causes the motor 50 to stop rotating the motor output shaft 52, which allows the cartridge valve 59 to be re-centered by the spring such that the fluid passage 23 diverts the flow of hydraulic fluid from the pump 38 back to the tank 40 as shown in FIGS. 4C and 6.

Figure 5A:
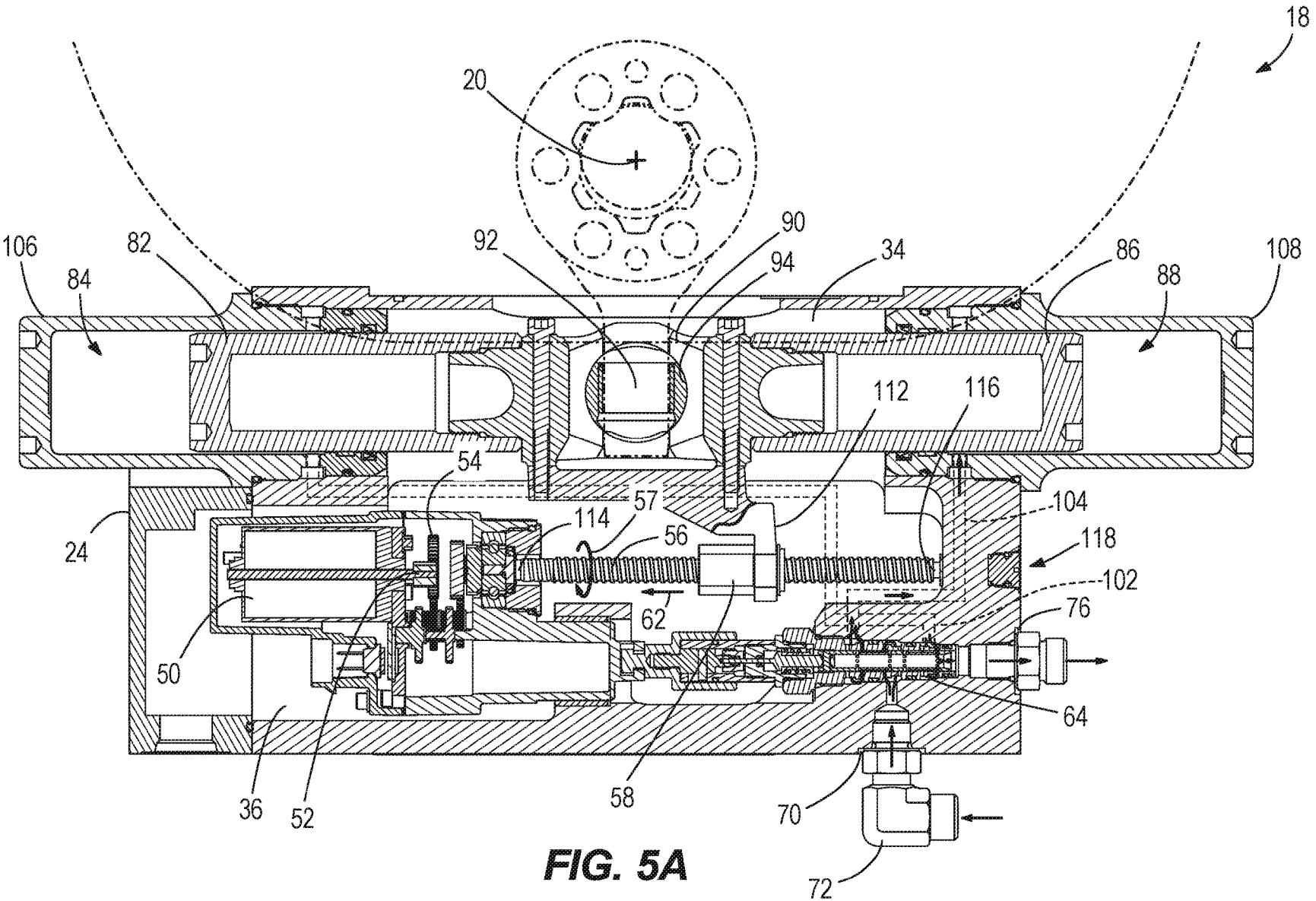
FIG. 5A is a sectional view of the steering actuator, showing movement of the valve device into a second position, opposite the first position shown in FIG. 4A.
Figure 5B:
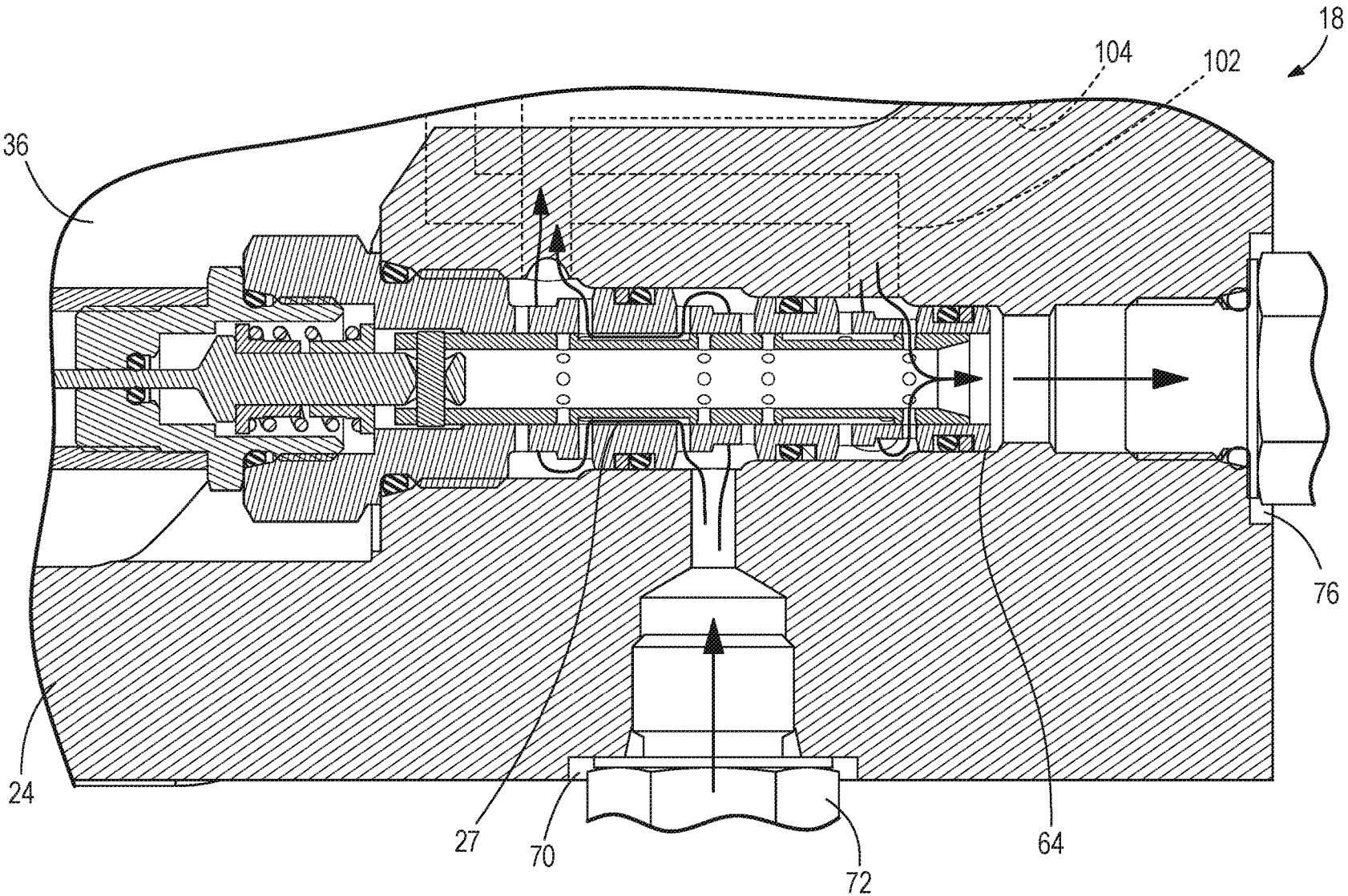
FIG. 5B is a closer sectional view of the valve device shown in FIG. 5A.
Figure 5C:
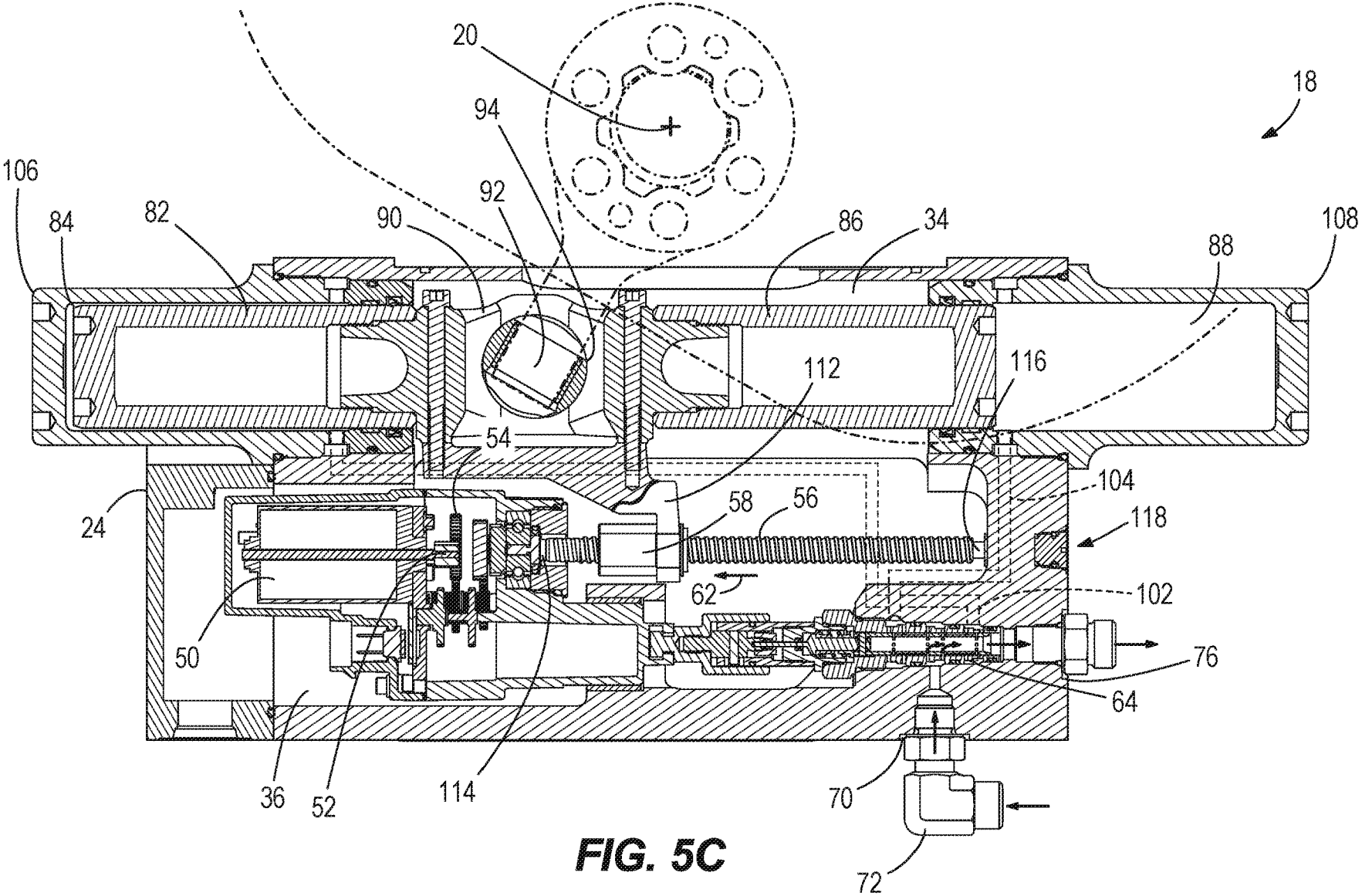
FIG. 5C is a sectional view of the steering actuator, showing the valve device back in the neutral position after pivoting movement of the outboard marine engine in a second pivot direction.
Figure 6:
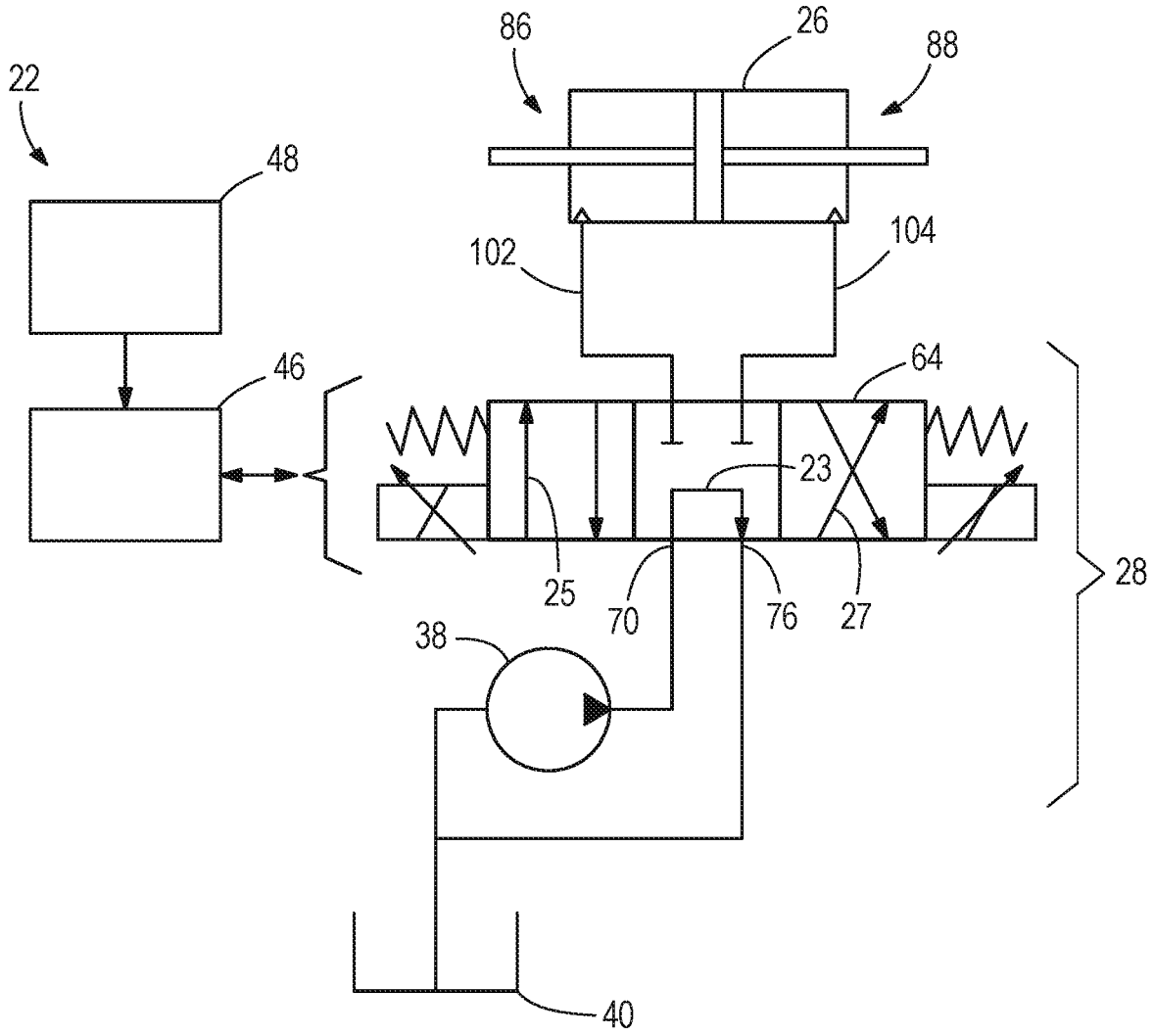
FIG. 6 is schematic view of an exemplary system for steering the outboard marine engine.

FIGS. 5A-5C depict the steering actuator 18 during an input to the controller 46 for movement of the outboard marine engine 10 about the vertical steering axis 20 in the noted second pivot direction.

FIG. 5A depicts the steering actuator 18 upon an input to the controller 46 for steering movement of the outboard marine engine 10 in the second pivot direction. The controller 46 controls the motor 50 to rotate the motor output shaft 52 in the noted second rotational direction, which causes commensurate rotation of the lead screw 56, thus resulting in axial travel of the ball nut 58 towards the motor 50. Initial movement of the ball nut 58 (i.e. to the left in FIG. 5A) is prevented by the relative heavy weight of the outboard marine engine 10 acting against the ball nut 58 via the connection bracket 112. That is, the ball nut 58 is connected to the outboard marine engine 10 via the connection bracket 112 and the trunnion 90. The force required to move the outboard marine engine 10 about the vertical steering axis 20 is greater than the force required to move the motor 50, the connection bracket 112, ball nut 58, motor 50 and cartridge valve 59 in the second cavity 36. As such, rotation of the motor 50 in the second rotational direction causes the motor 50 and cartridge valve 59 to move to the right in FIG. 5A which the fluid passage 27 in the cartridge valve 59 to align with the inlet 70 and outlet 76. This allows flow of hydraulic fluid from the pump 38 to the second hydraulic fluid passageway 104 and then into the second side 88 of the piston device 26. As shown by comparison of FIGS. 5A, 5B, to 5C, increasing the flow of hydraulic fluid to the second side 88 of the piston device 26 via the second hydraulic fluid passageway 104 increases the pressure on the second side 88, which acts on the second piston 86 and causes the second piston 86 to move the piston device 26 in the second piston direction (i.e. to the left in the Figures), which in turn, causes the outboard marine engine 10 to pivot in the first pivot direction, as shown in dashed lines in FIG. 5C. Once the requested pivoting movement of the outboard marine engine 10 is achieved (i.e. the requested pivoting movement inputted to the controller 46 via for example the user input device 48) the controller 46 causes the motor 50 to stop rotating the motor output shaft 52, which allows the cartridge valve 59 to be biased back into the neutral piston such that the fluid passage 23 diverts the hydraulic fluid from the pump 38 back to the tank 40 as shown in FIG. 5C.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A steering actuator for steering an outboard marine engine about a steering axis, the steering actuator comprising:

a piston device, wherein hydraulic actuation of the piston device causes the outboard marine engine to pivot about the steering axis; and a valve device, wherein the valve device controls a flow of hydraulic fluid to the piston device to thereby hydraulically actuate the piston device, the valve device comprising a lead screw, a motor configured to rotate the lead screw in a first rotational direction and alternately in an opposite second rotational direction, and a ball nut coupled to the lead screw such that rotation of the lead screw causes the ball nut to axially move along the lead screw;

wherein axial movement of the ball nut along the lead screw actuates the valve device, which thereby actuates the piston device to steer the outboard marine engine; and wherein the motor has an output shaft and wherein the lead screw is not coaxial with the output shaft.

2. The steering actuator according to claim 1, further comprising a gear set that connects the output shaft to the lead screw such that rotation of the output shaft causes rotation of the lead screw.

3. A steering actuator for steering an outboard marine engine about a steering axis, the steering actuator comprising:

a piston device, wherein hydraulic actuation of the piston device causes the outboard marine engine to pivot about the steering axis; and a valve device, wherein the valve device controls a flow of hydraulic fluid to the piston device to thereby hydraulically actuate the piston device, the valve device comprising a lead screw, a motor configured to rotate the lead screw in a first rotational direction and alternately in an opposite second rotational direction, and a ball nut coupled to the lead screw such that rotation of the lead screw causes the ball nut to axially move along the lead screw;

wherein axial movement of the ball nut along the lead screw actuates the valve device, which thereby actuates the piston device to steer the outboard marine engine; and wherein valve device is positionable into at least three positions, including a first valve position wherein the valve device directs the flow of hydraulic fluid to a first side of the piston device, a second valve position wherein the valve device directs flow of hydraulic fluid to the second side of the piston device, and a neutral position wherein the valve device directs the flow of hydraulic fluid back to a reservoir.

4. The steering actuator according to claim 3, wherein rotation of the lead screw in the first rotational direction causes the ball nut to move along the lead screw in a first axial direction and wherein rotation of the lead screw in the opposite, second rotational direction causes the ball nut to move along the lead screw in an opposite, second axial direction; and further wherein movement of the ball nut in the first axial direction causes the valve device to move the piston device in a first piston direction and wherein movement of the ball nut in the second axial direction causes the valve device to move the piston device in an opposite, second piston direction; wherein movement of the piston device in the first piston direction causes the outboard marine engine to pivot in a first pivot direction and wherein movement of the piston device in the second piston direction causes the outboard marine engine to pivot in an opposite, second pivot direction.

5. The steering actuator according to claim 4, wherein the piston device comprises a first piston coupled to a first side of the piston device and a second piston coupled to an opposite, second side of the piston device, and further comprising a first hydraulic fluid passageway that conveys the flow of hydraulic fluid from the valve device to the first side of the piston device to thereby cause the first piston to move the piston device in the first piston direction and a second hydraulic fluid passageway that conveys the flow of hydraulic fluid from the valve device to the second side of the piston device to thereby cause the second piston to move the piston device in the second piston direction, wherein the flow of hydraulic fluid to the first and second hydraulic fluid passageways is controlled by the valve device.

6. The steering actuator according to claim 5, wherein the ball nut is coupled to the piston device.

7. The steering actuator according to claim 3, wherein rotation the lead screw in a first rotational direction moves the valve device into the first valve position and wherein rotation of the lead screw in the second rotation direction moves the valve device into the second valve position.

8. The steering actuator according to claim 7, further comprising a return spring that returns the valve device into the neutral position.

9. The steering actuator according to claim 3, further comprising a housing that completely encloses the piston device, valve device, lead screw and ball nut.

10. The steering actuator according to claim 9, wherein the housing further encloses the motor.

11. The steering actuator according to claim 3, wherein the further comprising a position sensor coupled to the motor and configured to sense position of the steering actuator.

12. A steering actuator for steering an outboard marine engine about a steering axis, the steering actuator comprising:

a piston device, wherein hydraulic actuation of the piston device causes the outboard marine engine to pivot about the steering axis;

a valve device, wherein the valve device controls a flow of hydraulic fluid to the piston device to thereby hydraulically actuate the piston device, the valve device comprising a lead screw, a motor configured to rotate the lead screw in a first rotational direction and alternately in an opposite second rotational direction, and a ball nut coupled to the lead screw such that rotation of the lead screw causes the ball nut to axially move along the lead screw;

wherein axial movement of the ball nut along the lead screw actuates the valve device, which thereby actuates the piston device to steer the outboard marine engine; and a housing that completely encloses the piston device, valve device, lead screw and ball nut;

wherein the housing has an access port that facilitates access to the lead screw for positional adjustment of the lead screw, motor and valve device.

13. The steering actuator according to claim 12, wherein the lead screw comprises a first end coupled to the motor and an opposite, second end supported by the housing, wherein the access port is open to the second end such that the second end is accessible from outside the housing.

14. A system for steering an outboard marine engine about a steering axis, the system comprising:

an outboard marine engine;

a steering actuator that comprises a piston device, wherein hydraulic actuation of the piston device causes the outboard marine engine to pivot about the steering axis;

a valve device, wherein the valve device controls a flow of hydraulic fluid to the piston device to thereby hydraulically actuate the piston device, the valve device comprising a lead screw; a motor configured to rotate the lead screw in a first rotational direction and alternately in an opposite, second rotational direction; and a ball nut coupled to the lead screw such that rotation of the lead screw causes the ball nut to move along the lead screw, and wherein movement of the ball nut along the lead screw actuates the valve device, which thereby actuates the piston device to steer the outboard marine engine; and a controller that controls the motor to thereby actuate the valve device;

wherein the valve device is elongated and wherein the lead screw extends parallel to and is spaced apart from the valve device, and wherein the motor has an output shaft and wherein the lead screw is not coaxial with the output shaft.

15. The system according to claim 14, further comprising a pump that continuously pumps the flow of hydraulic fluid to the valve device.

16. The system according to claim 14, wherein rotation of the lead screw in the first rotational direction causes the ball nut to move along the lead screw in a first axial direction and wherein rotation of the lead screw in the opposite, second rotational direction causes the ball nut to move along the lead screw in an opposite, second axial direction; and further wherein movement of the ball nut in the first axial direction causes the valve device to move the piston device in a first piston direction and wherein movement of the ball nut in the second axial direction causes the valve device to move the piston device in an opposite, second piston direction; wherein movement of the piston device in the first piston direction causes the outboard marine engine to pivot in a first pivot direction and wherein movement of the piston device in the second piston direction causes the outboard marine engine to pivot in an opposite, second pivot direction.

17. The system according to claim 14, further comprising a housing that completely encloses the piston device, valve device, lead screw and ball nut.

* * * * *